US005255750A

United States Patent [19]

Wilkes, Jr. et al.

[11] Patent Number: 5,255,750

[45] Date of Patent: Oct. 26, 1993

[54] HYDRAULIC DRILLING METHOD WITH PENETRATION CONTROL

[75] Inventors: Robert D. Wilkes, Jr., Berkeley; Robert W. Dickinson, 40 Maplewood Dr., San Rafael, both of Calif. 94901; Charles S. Mackey, Bakersfield, Calif.

[73] Assignees: Ben W. O. Dickinson, III, San Francisco; Robert W. Dickinson, San Rafael, both of Calif.

[21] Appl. No.: 559,316

[22] Filed: Jul. 30, 1990

[51] Int. Cl.[5] ..... E21B 7/08; E21B 7/18

[52] U.S. Cl. ..... 175/61; 175/67; 299/17

[58] Field of Search ..... 175/27, 62, 65, 67, 175/77, 78, 321; 299/16, 17; 166/383

[56] References Cited

U.S. PATENT DOCUMENTS 2,271,005 1/1942 Grebe ..... 175/67
2,937,,007 5/1960 Whittle ..... 175/321
3,815,692 6/1974 Varley ..... 175/321
4,527,639 7/1985 Dickinson et al. ..... 175/67
4,763,734 8/1988 Dickinson et al. ..... 175/67
4,787,465 11/1988 Dickinson et al. ..... 175/67
4,790,384 12/1988 Schellstede et al. ..... 175/67
4,790,394 12/1988 Dickinson et al. ..... 175/67

*Primary Examiner*—David J. Bagnell
*Attorney, Agent, or Firm*—Flehr, Hohbach, Test, Albritton & Herbert

[57] ABSTRACT

Hydraulic drilling apparatus and method in which a drill head is driven toward the formation being drilled by the force of the drilling fluid, and the rate of advancement or penetration of the drill head is controlled by entrapping a fluid in a chamber to resist advancement of the drill head and allowing a controlled amount of the entrapped fluid to pass out of the chamber through an orifice to permit the drill head to advance at a controlled rate.

4 Claims, 1 Drawing Sheet

HYDRAULIC DRILLING METHOD WITH PENETRATION CONTROL

This invention pertains generally to hydraulic drilling apparatus and, more particularly, to a system and method for controlling the advancement or penetration of the drill head into the formation being drilled.

In hydraulic drilling operations, as described for example in U.S. Pat. Nos. 4,527,639 and 4,763,734, a highly pressurized drilling fluid is discharged through a drill head as high velocity a cutting jet which cuts away the material at which it is directed to form a borehole. As the material is removed, the drill head is advanced to extend the borehole into the earth. The drill head is typically attached to a tubular drill string to which the pressurized fluid is applied, and the force exerted on the drill string and head by the fluid drives them in the forward direction. The rate at which the drill head advances is limited by a cable which is attached to the drill string and played out at a controlled rate.

The use of the restraining cable has certain limitations and disadvantages. It requires not only the cable itself but also a drum or storage reel for the cable and a brake or some other means for controlling the rate at which the cable is played out. There is also a possibility that the cable may break, which would necessitate shutting down the drilling operation to recover the drill head, repair the cable, and possibly also repair or replace the drill head in the event that it is damaged by impacting with the formation when the cable breaks.

It is in general an object of the invention to provide a new and improved hydraulic drilling apparatus and method with penetration control.

Another object of the invention is to provide a hydraulic drilling apparatus and method of the above character which overcome the limitations and disadvantages of the apparatus heretofore provided.

These and other objects are achieved in accordance with the invention by inserting a drill tube into a casing with the distal end portion of the tube extending beyond the distal end of the casing, introducing a pressurized drilling fluid into the proximal end portion of the casing to drive the tube in a forward direction within the casing and to discharge a jet of the drilling fluid from the distal end of the tube, entrapping a fluid in a chamber which decreases in volume as the drill tube moves in the forward direction, permitting a first controlled amount of the entrapped fluid to pass from the chamber to thereby permit the drill head to advance at a first predetermined rate for a predetermined distance, and thereafter permitting a lesser amount of the entrapped fluid to pass from the chamber to reduce the rate at which the drill head advances.

Figures 1, 2:
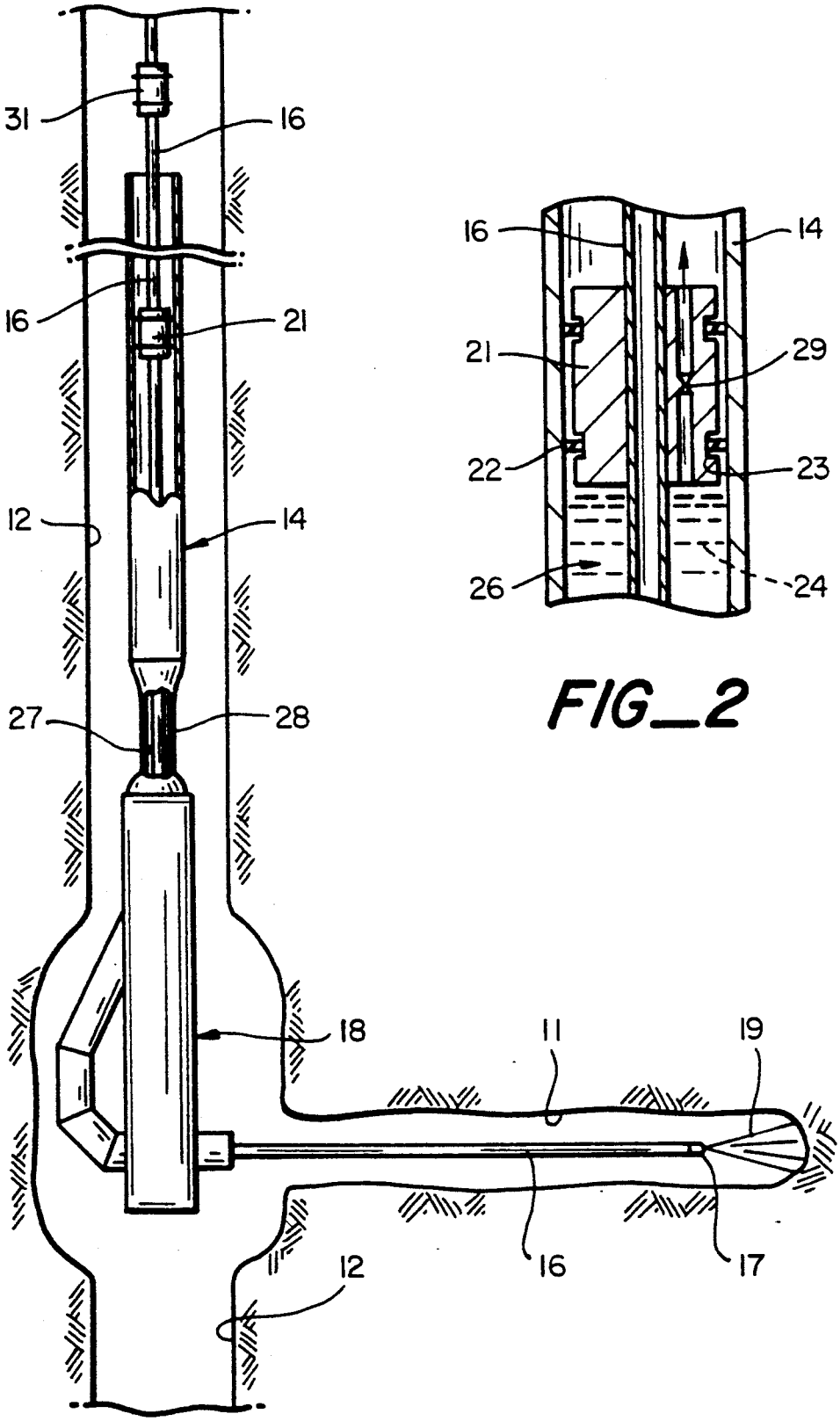
FIG. 1 is an elevational view, partly broken away, of one embodiment of drilling apparatus according to the invention.
FIG. 2 is an enlarged fragmentary cross-sectional view of the embodiment of FIG. 1.

In the drawings, the invention is illustrated in connection with the drilling of a radial bore 11 which extends horizontally from a vertical borehole 12 in the earth.

The drilling apparatus includes a tubular drill string 14 which extends vertically in the vertical borehole, with a radial drilling tube 16 extending axially within the string. The tube is movable axially within the string, and the distal end portion of the tube extends from the lower end of the string, with a drill head 17 at the distal end of the tube. A whipstock 18 connected to the lower end of the string bends the advancing tube so that the distal end portion of the tube extends in a horizontal direction into the radial bore 11.

A pressurized drilling fluid, e.g. water at a pressure of 10,000 psi, is introduced into the upper or proximal end of the drill tube. This fluid is discharged through the drill head as a high speed cutting jet 19 which is directed against the formation to be cut away at the end of the radial bore. The drill head can be of any suitable design, and in one presently preferred embodiment, it includes a nozzle which produces a cutting jet in the form of a thin conical shell, as disclosed in U.S. Pat. Nos. 4,787,465 and 4,790,394.

In addition to producing the cutting jet, the drilling fluid exerts a force on the radial drilling tube which drives this tube and the drill head in the forward direction into the borehole as described, for example, in U.S. Pat. No. 4,763,734.

Means is provided for resisting the forward movement of the drill head and tube to control the rate of advancement or penetration of the drill head into the borehole. This means includes a first piston 21 which is affixed to the upper or proximal end portion of the drilling tube and slidably positioned in the drill string. Rings 22 mounted in grooves 23 in the piston provide a fluidtight seal between the piston and the inner wall of the string.

A body of fluid 24 is entrapped in a closed chamber 26 which is formed between the piston and the lower end of the drill string 14. A seal 27 provides a sliding seal between the drilling tube and the inner wall of a coupling 28 between the drill string and the whipstock. The entrapped fluid can be any suitable fluid which is substantially noncompressible, and it can be the same type of fluid as the drilling fluid, e.g. water.

A restrictive orifice 29 extends between the upper and lower sides of the piston to provide a controlled escape of the entrapped fluid from chamber 26 in response to the pressure of the drilling fluid acting on the piston and the drilling tube 16. This permits the drilling tube and the drill head to advance in the forward direction at a controlled rate which is dependent, in part, upon the size and shape of the orifice and the pressure of the drilling fluid acting on the piston. In the embodiment illustrated, the orifice extends in an axial direction between the upper and lower sides of the piston. However, it can extend in any direction as long as it provides communication between the two sides of the piston. The orifice can, for example extend in a radial direction between the annular piston and the inside of the drilling tube.

A second piston 31 is affixed to the drilling tube between the first piston 21 and the proximal end of the tube. The second piston is spaced from the first piston so the drilling tube can advance a predetermined distance through the whipstock and string before the second piston enters the string and forms a seal therewith. The two pistons can be separated by any desired distance, and in some embodiments, for example, they are spaced apart by a distance corresponding to the distance tube 16 travels through the whipstock, e.g. about 10 feet. Piston 31 is similar to piston 21, with the relative sizes and shapes of the orifices in the two pistons being selected in accordance with the rates at which the fluid is to pass through the pistons.

Operation and use of the drilling apparatus, and therein the method of the invention, are as follows.

After the vertical bore 12 has been formed, drill string 14, whipstock 18, and radial drilling tube 16 are lowered into the bore, with the distal end portion of the drilling tube extending into the whipstock and the chamber 26 being filled with water or other suitable fluid.

When pressurized drilling fluid is introduced, drilling tube 16 is driven in a downward direction, emerging from the whipstock in a horizontal direction. The drilling fluid is discharged in an axial direction from the drill head 17 at the distal end of the tube, cutting away the formation in front of the head to form the radial bore.

The fluid entrapped in the chamber 26 resists the movement of the drill head and tube, and prior to the time piston 31 enters the drill string, the orifice 29 in piston 21 permits a controlled discharge of the fluid from the chamber which permits the drill head to advance at a controlled rate corresponding to the size of this orifice. When the tube advances to the point that the second piston 31 enters the drill string, the combination of the two orifices in the pistons becomes the controlling factor in limiting the rate at which the fluid can escape from the chamber since the fluid passing through the orifice in the first piston must also pass through the orifice in the second piston, and the rate at which the tube moves through the string is thereby reduced. The two pistons thus provide a two speed control for the advancement of the drilling tube. The tube moves at one speed for a distance corresponding to the separation between the pistons, and thereafter moves at a second, slower speed.

The invention has a number of important features and advantages. It permits the rate of drill head advancement or penetration to be controlled without cables or the other equipment required by the prior art. It is easy and economical to implement, and it provides good control over the drilling rate. In addition, it permits the tube which carries the drill head to advance through a whipstock at a relatively rapid rate until the drill head emerges from the whipstock and thereafter to advance at a slower rate as the formation is cut away.

It is apparent from the foregoing that a new and improved hydraulic drilling apparatus and method have been provided. While only certain presently preferred embodiments have been described in detail, as will be apparent to those familiar with the art, certain changes and modifications can be made without departing from the scope of the invention as defined by the following claims.

We claim:

1. In a hydraulic drilling method, the steps of: inserting a drill tube having first and second axially spaced pistons affixed thereto into a drill string with the first piston in sealing engagement with the wall of the string and the second piston outside the proximal end of the string, driving the tube in a forward direction within the string with a pressurized drilling fluid, discharging a jet of the drilling fluid from the distal end of the tube, entrapping a fluid between the first piston and the distal end of the string to resist movement of the tube in the forward direction, allowing a controlled amount of the entrapped fluid to bypass the first piston to permit the tube to move in the forward direction at a first rate until the second piston enters the string, and thereafter allowing only a portion of the fluid bypassing the first piston to bypass the second piston to reduce the rate at which the tube advances through the string.

2. In a method of drilling boreholes which extend radially from a vertically extending borehole in the earth, the steps of: inserting a drill tube having first and second axially spaced pistons affixed thereto into a drill string with the first piston in sealing engagement with the wall of the string and the second piston outside the proximal end of the string, driving the tube in a forward direction within the string with a pressurized drilling fluid, discharging a jet of the drilling fluid from the distal end of the tube, bending the tube to extend in a horizontal direction as it advances from the string, entrapping a fluid between the first piston and the distal end of the string to resist movement of the tube in the forward direction, allowing a controlled amount of the entrapped fluid to bypass the first piston to permit the tube to move in the forward direction at a first rate until the second piston enters the string, and thereafter allowing a lesser amount of the fluid to bypass the second piston to reduce the rate at which the tube advances through the string.

3. In a hydraulic drilling method utilizing an elongated tubular member having proximal and distal ends, a drill head at the distal end of the tubular member, and a chamber which decreases in volume with movement of the drill head in a forward direction, the steps of: driving the tubular member and the drill head in a forward direction with a pressurized drilling fluid, discharging a cutting jet of the drilling fluid from the drill head, entrapping a body of fluid in the chamber to resist movement of the drill head in the forward direction, permitting a first controlled amount of the entrapped fluid to pass from the chamber to thereby permit the drill head to advance at a predetermined rate for a predetermined distance, and therefore permitting a lesser amount of the entrapped fluid to pass from the chamber to reduce the rate at which the drill head advances.

4. In a method of drilling boreholes which extend radially from a vertically extending borehole in the earth, the steps of: inserting a drill tube into a vertically extending drill string with the distal portion of the tube extending beyond the distal end of the string, driving the tube in a forward direction within the string with a pressurized drilling fluid, discharging a jet of the drilling fluid from the distal end of the tube, bending the tube to extend in a radial direction as it advances from the string, entrapping a fluid in a chamber which decreases in volume as the tube moves in the forward direction, allowing a first controlled amount of the entrapped fluid to pass out of the chamber to permit the tube to move in the forward direction at a first rate, and thereafter reducing the amount of the fluid which passes out of the chamber to reduce the rate at which the tube moves.

* * * * *